US006929094B1

(12) United States Patent
Kohlmeier et al.

(10) Patent No.: US 6,929,094 B1
(45) Date of Patent: Aug. 16, 2005

(54) RESTRAINT SYSTEM, APPARATUS AND METHOD FOR LADDER SYSTEM

(76) Inventors: Scott Kohlmeier, 3000 Niagara St., Bellingham, WA (US) 98226; Ronald H. Parks, 1014 W. 54th La., Bellingham, WA (US) 98226

( * ) Notice: Subject to any disclaimer, the term of this patent is extended or adjusted under 35 U.S.C. 154(b) by 0 days.

(21) Appl. No.: 10/735,195

(22) Filed: Dec. 12, 2003

(51) Int. Cl.[7] ..... E06C 7/18; E04G 1/00
(52) U.S. Cl. ..... 182/106; 182/230
(58) Field of Search ..... 182/194, 94, 93, 182/230, 106, 179.1, 107, 113

(56) References Cited

U.S. PATENT DOCUMENTS 2,539,664 A 1/1951 Hay
3,106,986 A * 10/1963 Ray ..... 182/106
5,255,758 A 10/1993 Hood, Jr.
6,607,053 B1 8/2003 Warren

* cited by examiner

*Primary Examiner*—Hugh B. Thompson, II
(74) *Attorney, Agent, or Firm*—Hughes Law Firm, PLLC; Robert B. Hughes

(57) ABSTRACT

A fall restraint system to be incorporated in an existing ladder system where there are ladder stations, each having a platform, a ladder extending up from the platform, a safety cage around an upper portion of the ladder, and a perimeter guard rail. There is a plurality of adjustable fall restraint sections extending from the upper rail member of the guard rail to a lower cage element of the safety cage. The end connecting members and their intermediate restraint members are made adjustable to accommodate different locations and configurations.

20 Claims, 11 Drawing Sheets

RESTRAINT SYSTEM, APPARATUS AND METHOD FOR LADDER SYSTEM

The present invention relates to a restraint system to be used in a ladder system where there is an open area which needs to be enclosed by a restraint system, and more particularly, to a restraint system which is used in a ladder system where there are ladder stations vertically aligned with one another and each station comprises a platform, an upwardly extending ladder, a safety cage and a guardrail.

BACKGROUND OF THE INVENTION

For a number of decades, there have been ladder systems adjacent to towers, building structures, etc. Quite commonly these ladder systems will have a plurality of ladder stations (approximately twenty feet in height) positioned one above the other. Each station comprises a platform which would be positioned against a wall or other structure, with a ladder extending upwardly from one side of the platform and adjacent to the wall or other structure. At a level of about six or seven feet above the ladder, there is a safety cage that surrounds the ladder, and also a guardrail that extends around the parameter of the platform.

Quite commonly the lower end of the safety cage would be about six or seven feet above the level of the platform to provide clearance for people to move around on the platform, and the guardrail would be at a lower elevation, possibly four feet high. Thus, there is a gap or open region between the lower end portion of the safety cage and the upper rail member. Some time ago there were enacted OSHA regulations which required that these ladder systems should have a restraint system to enclose the open area between the lower part of the safety cage and the upper part of the rail. The problem was that if a person fell of a ladder and dropped through the area defined by the safety cage, upon arriving at the platform, the person might accidentally fall over the guard rail. (For example the person might stumble and thus move sideways in an off balance position.)

To the best knowledge of the applicants, the task of retrofitting the ladder stations with a restraint system has to some extent lacked adequate designs and in large part the retrofit has been made by taking various iron or steel components and welding them in place. Also, one of the problems in attempting to find a design for such restraint systems is that while the guard rail and the safety cage have generally the same overall arrangement, there are differences in their positioning, and also in the configuration of some of the components.

The embodiments of the present invention are particularly designed to provide a restraint system which would be relatively easy to install, and also be adaptable for various arrangements of the ladder systems.

DETAILED DESCRIPTION OF THE PREFERRED EMBODIMENTS

In describing the embodiments of the present invention, there will first be described, with reference to FIG. 1, a commonly used prior art ladder system. After that, there will be a description of the four embodiments of the fall restraint system of the present invention which is to be used in this ladder system 10.

a) The Prior Art Ladder System

Figure 1:
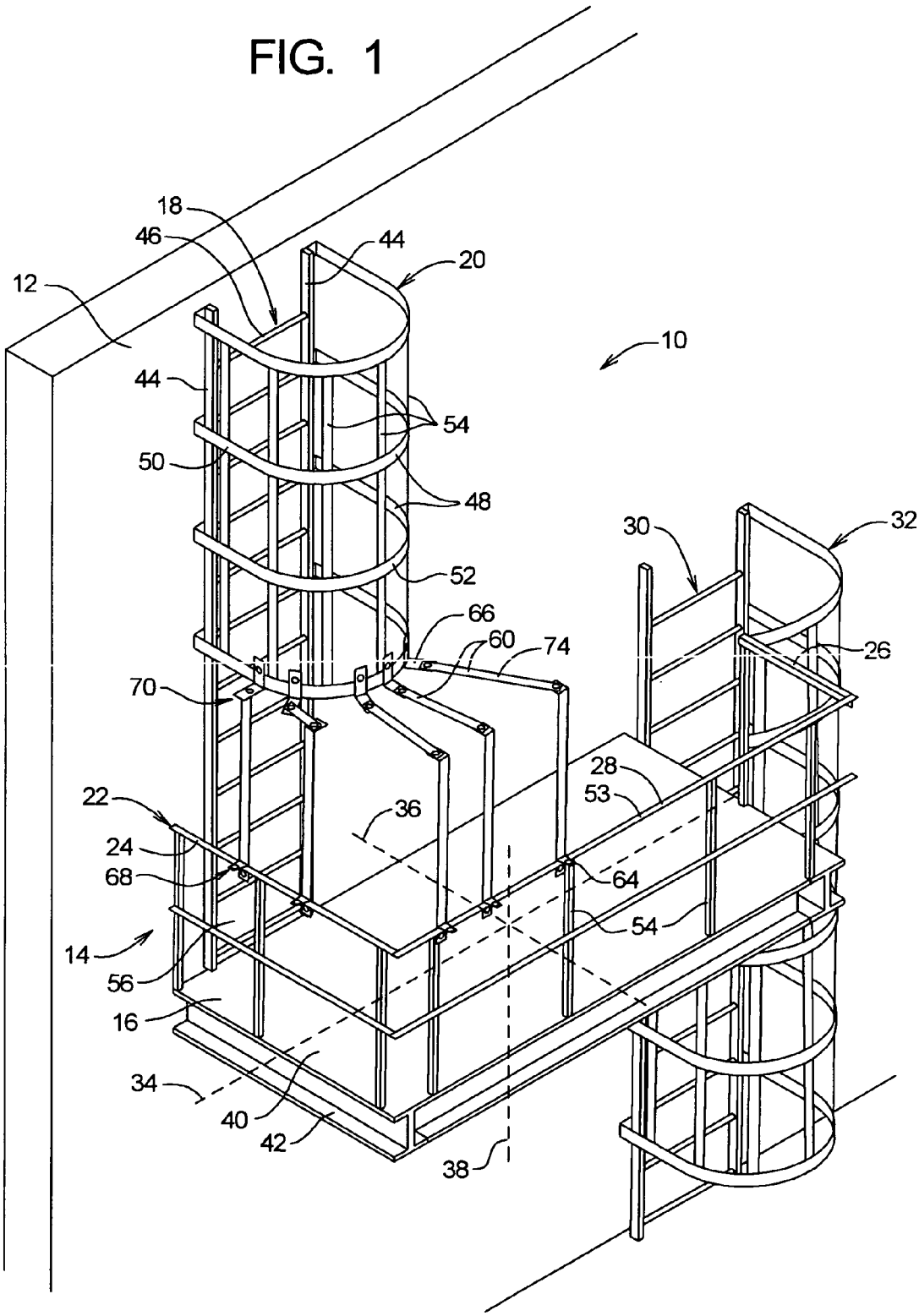
FIG. 1 is an isometric view showing a typical prior art ladder system with a first embodiment of the present invention being utilized in this ladder system.

In FIG. 1, there is shown a typical prior art ladder system 10 and also a fall restraint system 10 of a final embodiment of the present invention the ladder system 10 is shown mounted to a wall structure 12 which could be a tower, a wall of an industrial structure such as a refinery, etc. The ladder system 10 comprises a plurality of ladder stations 14 which are positioned one above the other and mounted to the wall section 10. There is shown one station 14 of the ladder system 10, and this station comprises a platform 16, a ladder section 18, a safety cage 20, and a guardrail 22. The platform 16 as shown herein is a horizontal rectangular structure, with it's rear side being in contact with, or connected to, the wall structure 12. The guardrail 22 extends along the perimeter of the platform 16 and comprises first and second side rail sections 24 and 26 respectively, and a front rail section 28 running along the front of platform 16.

At the right rear corner of the platform 16, there is a second ladder section 30 and a cage section 32 which are part of the ladder station immediately below.

For purposes of description and to provide a frame of reference for various components, the platform 16 shall be considered as having a lateral axis 34 which runs along a lateral center line of the platform 16 and is parallel to the wall structure 12, a front to rear axis 36 that extends along a front to rear center line of the platform 16 and is perpendicular to the lateral axis 34, and a vertical axis 38 extending perpendicular to the axis 34 and 36 and extending through the intersection point of the axis 34 and 38.

The platform 16 comprises a flat deck 40 and three support beams 42 extending beneath the edge portions of the platform 20. The ladder section 18 comprises two vertically extending side members 44 with rungs 46 extending between the side members 44.

The safety cage 20 comprises a plurality of cage elements 48 which are connected to the ladder side members 44 and are vertically spaced from one another. Each cage element in this embodiment is made as a single flat metal strip having two straight side portions 50, the rear ends of which are connected to ladder side and a front 180 degree curved portion 52 extending at the forward ends of side portions 50. Vertical bracing members 52 connect the cage elements 50 and 48 to one another form a rigid structure. The guardrail comprises 22 horizontal rail members 53 and vertical rail members 54.

The components 10–54 which have been described in the text above already exist in the prior art, and while there are variations in the various ladder systems 10, the components which are described above are typical of these installations. Commonly, each ladder system station 14 has a height dimension of approximately twenty feet or more.

To describe the manner in which the ladder system 10 is used, let us assume that a workman is climbing up each ladder section 18 of each system station 14, and the workman is now climbing up the lower ladder section 32 shown in FIG. 1 and reaches the platform 16. The workman then steps onto the platform 16 and walks over through the next ladder section 18 climbs up that ladder section 18 and to a platform which is positioned above the platform 16. After arriving at the upper platform opening, the workman walks across the platform to the opposite side to climb up another ladder, and continues in that pattern to the desired location along the wall structure 12. Substantially the same procedure is followed with the ladder system shown in FIG. 1A.

If the workman slips while he is ascending the ladder section 18, for example, the safety cage 20 will prevent the workman from falling outwardly from the ladder 18 and from the building structure 12, so that if he continues falling he will be confined along a vertical path defined by the cage 20 to land on the platform 16. Also, the guardrail 22 (as it's name implies) further provides a safety benefit.

However, while the safety cage 20, the platform 16 and the guardrail 22 have provided substantial safety benefits, there has remained a problem. The lowermost cage element 48 of the safety cage 20 is generally six or seven feet above the upper surface of the platform 16, and with the upper edge of the guardrail 22 being at an elevation well below that, there is still a gap (i.e. an empty air space) between the lowermost cage element 48 and the upper horizontal rail member 53 of the guardrail 22, and this open air space is indicated at 56 in FIG. 1. Thus, there is also the risk that a person who is falling from the ladder and moving down through the safety cage might upon falling from the bottom part of the cage 20 stumble or lose his balance and fall over the guardrail 22.

Accordingly, some time ago section 11910.27 of the OSHA requirements was implemented and this requires that any elevated platform that does not extend four feet beyond the center of the ladder rungs must use some method of extending the ladder cage to the hand rail. Thus, there are a large number of these ladder systems 10 which require some remodel or retrofit to come into compliance. One of the problems however is that while there is a basic commonality among these ladder systems 10 in terms of the overall structure, the dimensions and the relative positioning components generally vary from one system 10 to the other. Also, some of the components differ, in terms of their structure. For example, the guardrail may use round tubing or angle irons as some of the horizontal rail elements. Also, there are variations in the specific structures of the safety cage elements 48.

The embodiments of the present invention were designed to alleviate these problems and provide an apparatus and method that could be used with essentially any and all of the existing system 10 by in spite of these variations in shape, dimensioning and relative location.

b) The Final Embodiment of the Present Invention

Figure 2:
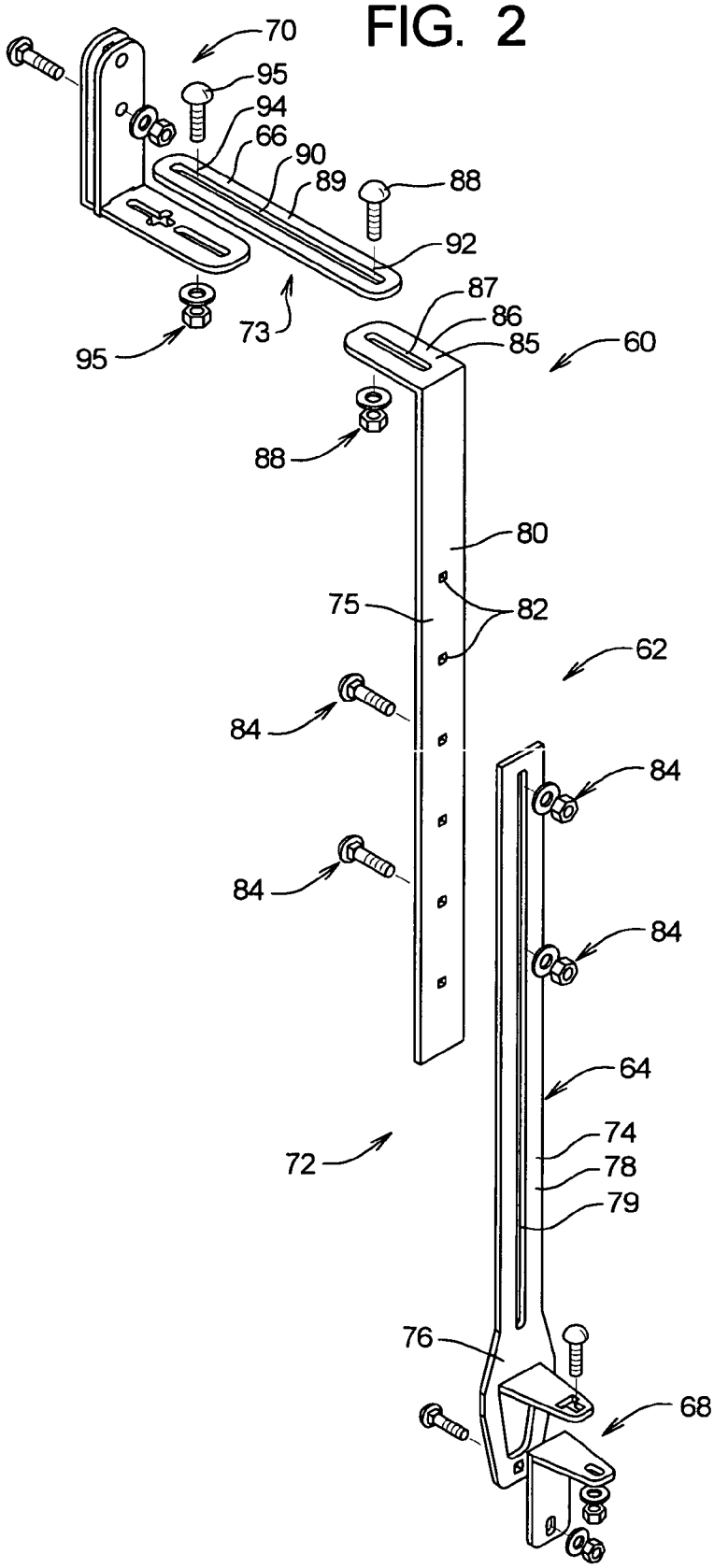
FIG. 2 is an isometric exploded view of a restraint section of the present invention.

To describe now the first embodiment of the present invention, reference is first made to FIGS. 1 and 2. The restraint system 11 comprises a plurality of restraint sections 60 which are connected to, and extend between, a lower cage element 48 and the upper rail member 53, and these are positioned at laterally spaced intervals around the open region 56 that is proximate to of the cage 20 and the ladder section 18.

Each restraint section 60 comprises an elongate restraint component 62 having first and second end portions 64 and 66, and further comprises a rail connecting component 68 and a cage connecting component 70. The rail connecting component 68 connects the first end portion 64 of the restraint component 62 to an upper one of the rail members 53. In like manner, the cage connecting component 70 connects the second end portion 66 of the restraint portion 60 to a lower one of the cage elements 48.

The restraint component 62 of each of the restraint sections 60 comprises a rail engaging restraint section 72 and a cage engaging restraint section 73 that connect to one another at adjacent end portions and collectively from the elongate restraint component 62.

The rail engaging restraint section 72 (as it's name implies) is attached to an upper rail member 53 and extends generally vertically in an upward direction from the upper rail member 53 and is extendable and retractable. Further, this rail engaging restraint section 72 comprises a rail engaging portion 74 that is attached to the upper rail member 53 and an extension portion 75 which is adjustably connected to the rail engaging portion 74 so as to be positioned in various positions along it's length.

The rail engaging portion 74 in turn comprises a rail connection portion 76 that connects directly to the rail member 53 and an upwardly extending restraint portion 78 to which the extension portion is adjustably engaged. The rail connecting portion 76 will be described later in this text in connection with the description of rail connecting component 68 (described later in the text).

The upwardly lower extending restraint portion 78 is formed as a flat elongate generally rectangular member having a vertically aligned center slot 79. The above mentioned extension portion 75 comprises a vertically aligned extension element 80 which is formed as a flat bar member having a rectangular configuration substantially matching the cross sectional configuration of the upwardly extending lower restraint member 78. This extension element 80 has a plurality of holes 82 along a vertical alignment axis of the extension element 80, with these holes being equally spaced from one another.

There are provided two fasteners, in the form of two fastener assemblies 84 which extend through the slot 79 and through selected holes 82 of the extension element 80 to position the extension portion 75 at the desired location. The extension portion 75 further comprises an upper connecting portion 85 which is connected to (or internally formed with) the upper end portion of the vertical extension portion 80. This upper connection portion 85 comprises a horizontally extending flat connecting member 86 having a slot 87 extending along a center of the connecting portion 85. There is a fastener assembly 88, the same as (or similar to) fastener assembly 84, and this is used to connect to the cage engaging restraint section 73.

This cage engaging restraint section 73 has a configuration of a flat elongate bar 89 which has a slot 90 extending along a lengthwise central line of the bar 89. This slot 90 provides two connecting locations 92 and 94. The connecting location 92 is at the location of the connector assembly 88 where the connecting portion 85 of the rail engaging restraint section 72 connects to cage engaging restraint section 73. The second connecting location 94 is at the location of a second connecting assembly 95 which extends through the slot 90 and the slot 94.

It is apparent by viewing FIG. 2 that the horizontal angular orientation of the bar 89 of the cage engaging restraint section 73 relative to the cage connecting component 70 and also to the upper connecting portion 85 can each be changed. Also, the position of this bar 89 can be varied simply by positioning the fastener assembly 88 at various locations along the length of the slot 90 of bar 89. Thus both the effective length and the angular position of the cage engaging restraint section 73 can be adjusted independently of one another.

c) The Rail Connecting Component of the First Embodiment

Figure 3:
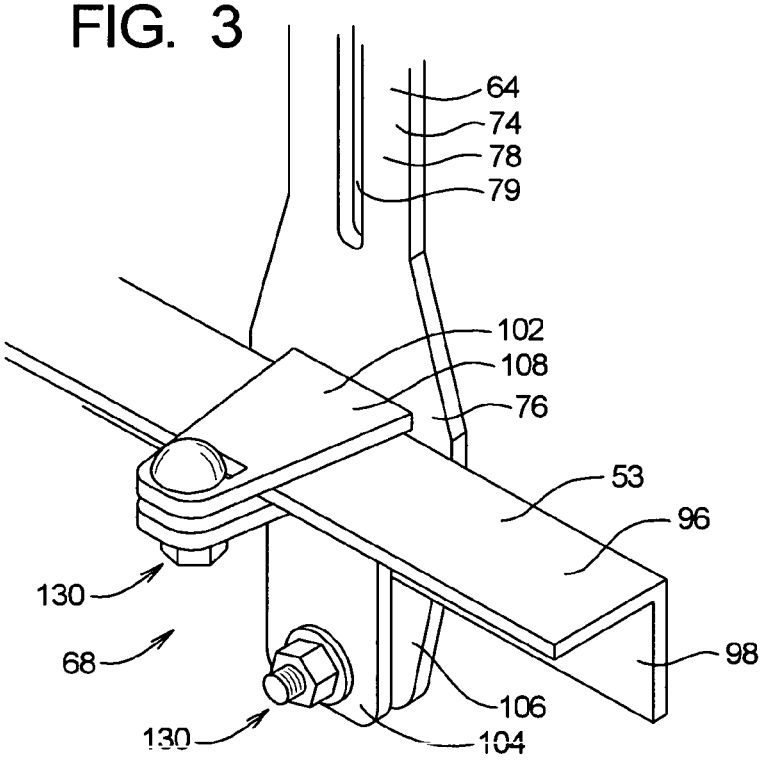
FIG. 3 is an isometric view of a rail in it's assembled condition.
Figure 4:
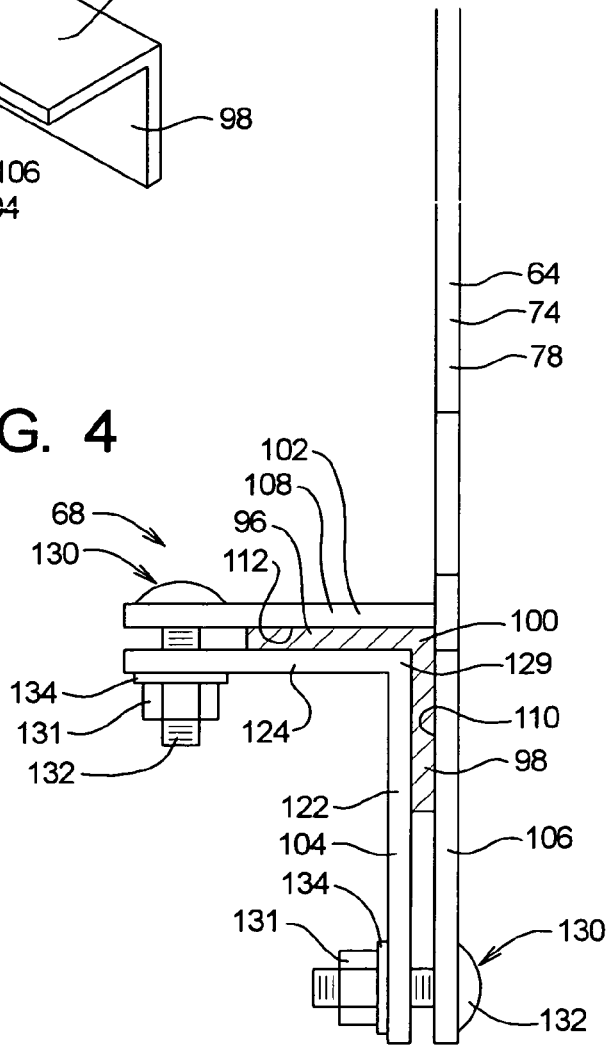
FIG. 4 is a side elevational view, partly in section, of FIG. 3.
Figure 5:
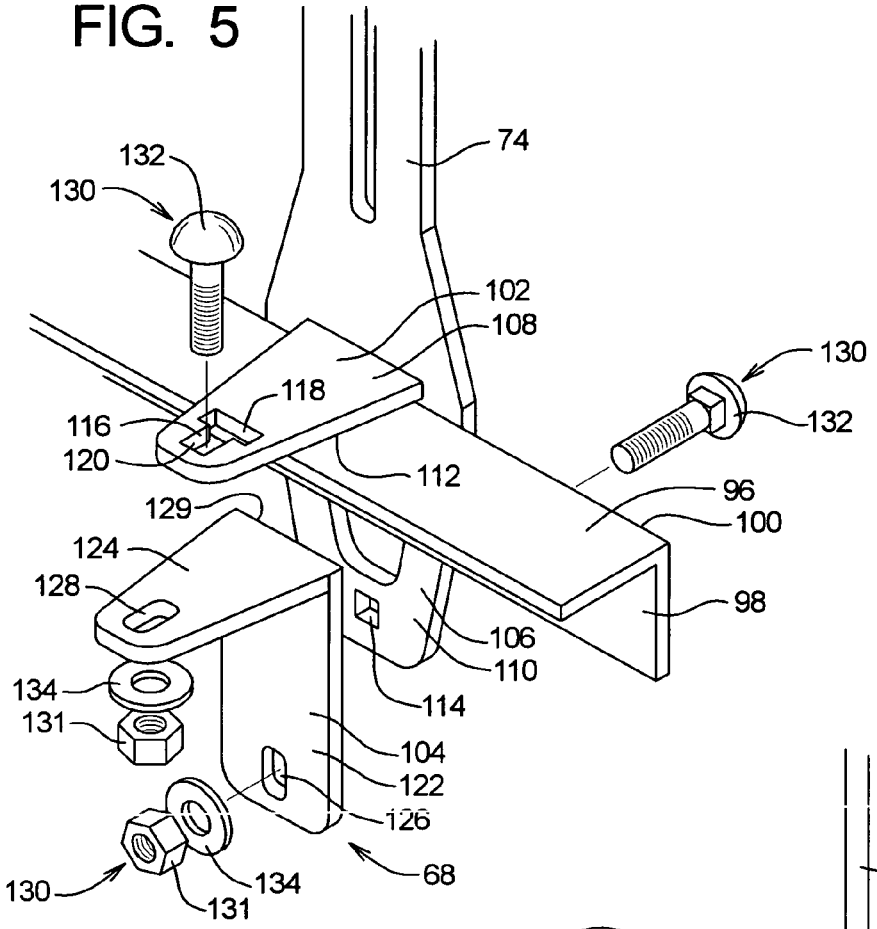
FIG. 5 is an exploded isometric view of FIG. 3.
Figure 6:
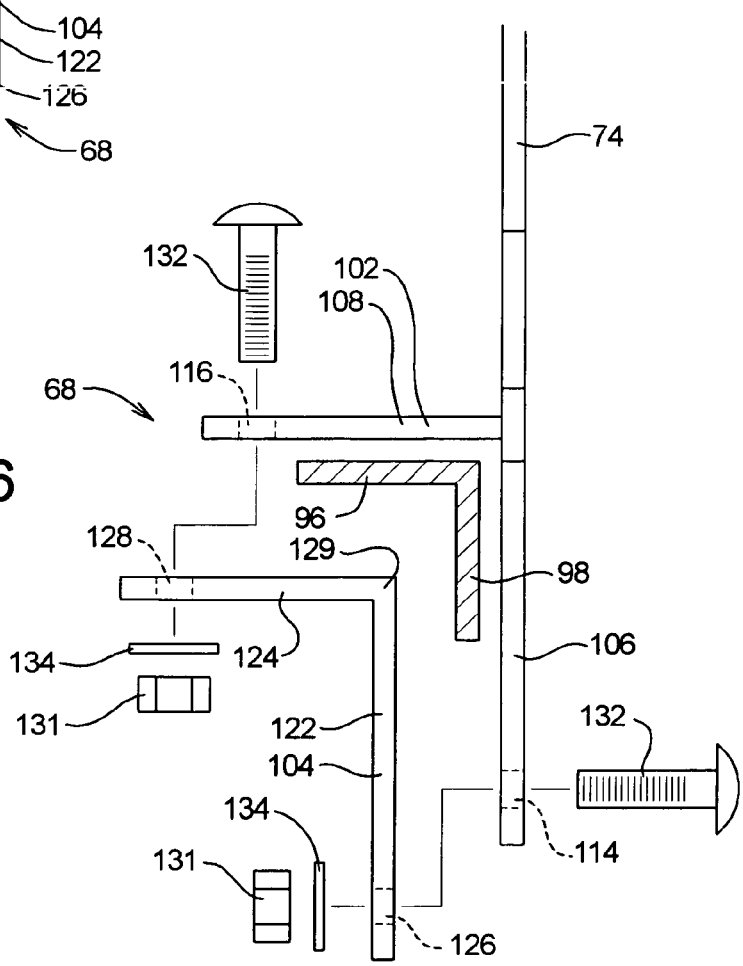
FIG. 6 is a side elevational exploded view of FIG. 3.

Let us now turn our attention to the aforementioned rail connecting component 68. References is first made to FIGS. 3 through 6 which shows this component 68, with FIGS. 3 and 4 showing it in it's assembled operating configuration, and with FIGS. 5 and 6 being two exploded views, and with FIG. 5 being an isometric view and the FIG. 6 being a side elevation view.

In this particular embodiment, the upper rail member 53 to which the rail connecting component 68 is attached is in the form of an angle iron comprising in cross section horizontal and vertical flanges or webs 96 and 98 are make at right angle with respect to one another and meet at a junction location 100. The term "angle iron" is used in the conventional sense of meaning this particular type of a beam, and it is not necessarily limited to the meaning that it is made of a material which is iron or steal. However, in this embodiment, all of the components can be made of steal but could also be made from other metals, composites, plastic, etc.

This rail connecting component 68 of the embodiment is particularly configured to be connected to a rail member 53 having the angle iron configuration. The connecting component 68 comprises a positioning component 102 and a clamping component 104. In the particular arrangement shown herein the positioning component 102 is made integrally as part of the rail engaging portion 74 of the rail engaging restraint section 72 and has previously been given of the designation 76. However, in the description that follows, the component that is the aforementioned rail connecting portion 76 will be referred to as a positioning component 102, since this positioning component 102 could be made as a separate member that is then attached to the rest of the structure of the rail engaging restraint section 72.

The positioning component 102 comprises a flat plate like vertical portion 106 and a flat plate like horizontal portion 108, with these being connected to one another at adjacent edge portions so as to form a right angle configuration matching that of the right angle guard rail member 53. As shown here in, for convenience of manufacture, the horizontal portion 108 is made integrally with the lower end of the rail engaging portion 74 by making a U-shaped cut and then bending or otherwise forming the portion so that it extends outwardly at a right angle orientation, with the remaining end portion of the rail connecting portion 76 remaining in it's original coplanar position, and forming the vertical portion 106.

The vertical and horizontal portions 106 and 108 have flat positioning surfaces 110 and 112 respectively to bear against matching side surfaces of the right angle rail member 53. There are fastener openings 114 and 116 at end locations of the vertical and horizontal portions of 106 and 108, respectively. The opening 114 of the vertical portion 106 has a square configuration, to receive a matching square head portion of a connecting carriage bolt. In the drawings for ease of illumination the bolts are shown without the square head portion, and is understood that these bolts could have that configuration. The opening 116 has a T shaped configuration where the leg 120 of the T is aligned in a forward to rear direction, and the top rear part 118 of the T extends at right angles thereto. The reason for this will become apparent later in this description, but to comment briefly on it at this time, one of the advantages of the present invention is that it is able to use some of the same components to accommodate different configurations of both the rail member 53 and the cage element 48. The opening 116 is designed to receive an end portion of one of those members.

The clamping component 104 is a right angle member and comprises a vertical clamping portion 122 and a horizontal portion 124 which join to one another at edge portions in a right angle configuration to match that of the rail member 53 and of the positioning component 102. The vertical and horizontal clamping portions 122 and 124 have at outer end potions thereof openings 126 and 128 respectively, with each of these being a slotted opening in a direction perpendicular to the alignment of a juncture location 129 of the two clamping portions 122 and 124, to allow for different thicknesses of the flanges 96 and 98 of the rail member 53.

There are provided two fasteners 130, each of which comprises a nut 131, a bolt 132 and a washer 134. These fasteners 130 are desirably the same as the fasteners 84 and 95 disclosed earlier in this text. With the positioning component 102 and the clamping component 104 positioned in the clamping position of FIG. 4, with the two bolts 132 being positioned so as to extend through the pair of openings 116 and 128, and also through the pair of openings 114 and 126, the nuts 31 of these fasteners are tightened so as to hold the positioning component 102 and the clamping component 104 in place and to press tightly against the rail member 53, so that the rail connection portion 76 of the rail engaging portion 74 is fixedly positioned relative to the rail member 53. Thus, the orientation of the entire rail engaging restraint section 72 is also fixed.

d) The Cage Connecting Component 70 and the First Embodiment

Figure 7:
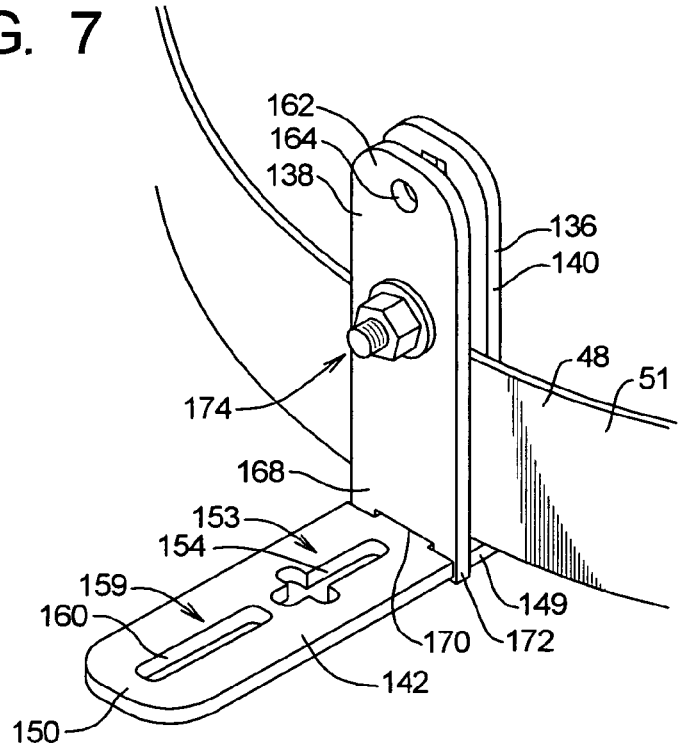
FIG. 7 is an isometric view of an assembled cage connecting element.

Reference is now made to FIGS. 7 through 10 to describe the cage connecting component 70. The cage element 48 shown in FIG. 7 is formed of an elongate planar metal strip which has the afore mentioned side portions 50 and front curved portion 51. There is a positioning component 136 and a clamping component 138. The positioning component 136 comprises a vertical portion 140 and a horizontal portion 142 which connect to one another at adjacent edge portions, and are at right angles to one another. The upper part of the vertical portion 140 has vertically spaced openings 144 and 146, each of these having a square configuration to mate with matching square portions of the carriage bolts used as connectors, and a forwardly facing positioning surface 148.

The horizontal portion 142 of the positioning component 136 shall be considered as having an inner end portion 149 that is located only a short distance away from the lower rear end portion of the vertical portion 140, and an oppositely positioned outer end portion 150 at a further distance vertical position 140. At a location of the inner end portion 149 closely adjacent to the cage element 48, there is a first connecting location 151 where side portions of the horizontal portion 142 are formed with laterally aligned notches 152. There is a second connecting location 153 which is positioned outwardly of the first connecting position in location 151, and there is at this location 153 an opening 154 having the configuration of a cross where there is an elongate forward to rear slot 156 and a cross slot 158 which is positioned at that portion of the slot 156 that is closer to the outer end portion 150.

Then there is a third connecting location at 159, and at this location 159 there is an elongate connecting slot 160 which extends along a lengthwise center line of the horizontal portion 142. As will be described later, this slot 160 is to receive the aforementioned connector 95 that was mentioned previously in describing the connections of the cage engaging restraint section 73.

The function of the notches 152 at the connection location 151 is to engage the lower end of the clamping component 134. The clamping component 134 has the overall configuration of a flat metal bar with an upper portion 162 that has two vertically spaced openings 164 and 166. At a lower portion 168 of the clamping component 134 there is a central downwardly facing rectangular notch or cut out 170 which forms a pair of oppositely positioned downwardly extending lower legs 172 which fit in the notches 152.

There is a single nut, bolt and washer fastener generally designated 174, and including the nut 176, the bolt 178 and the washer 180. In the assembled position of FIG. 7, the vertical portion 140 of the positioning component 136 is positioned immediately behind the cage element 48, and the clamping component 138 is positioned at the opposite outside surface of the cage element 48. The two legs 172 of the clamping component 134 are positioned in the notches 152 to retain the lower portion 168 of the clamping component 134 in the proper position, adjacent to the outer surface of the cage element 48 and the connector 174 is tightened up to press the upper portion 162 of the clamping component 174 against the cage element 148.

Figure 8:
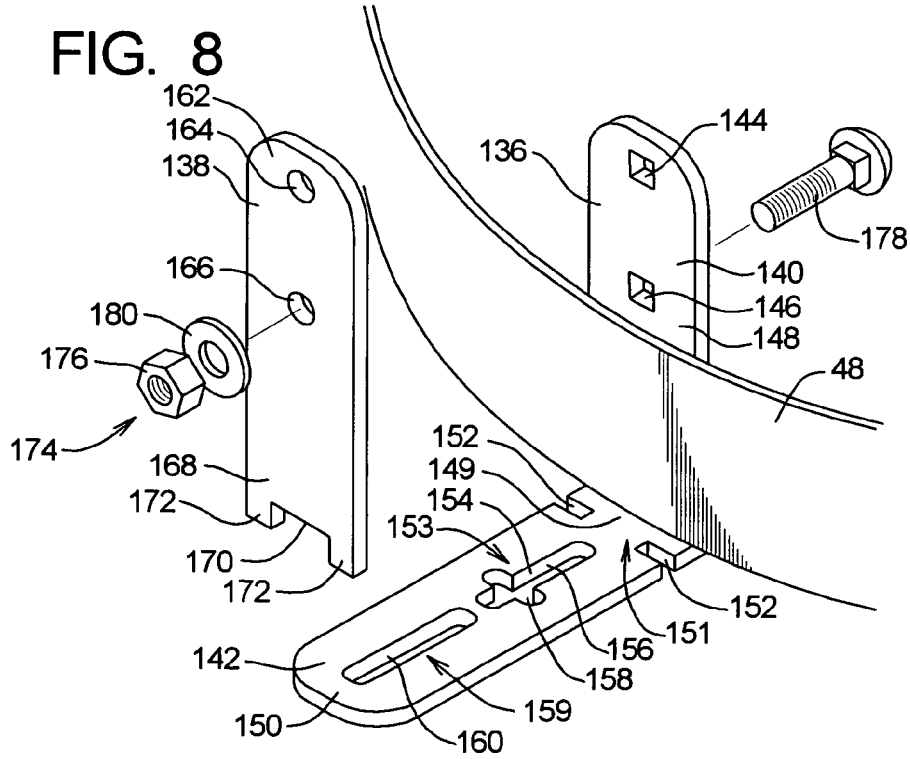
FIG. 8 is an isometric exploded view of FIG. 7.
Figure 9:
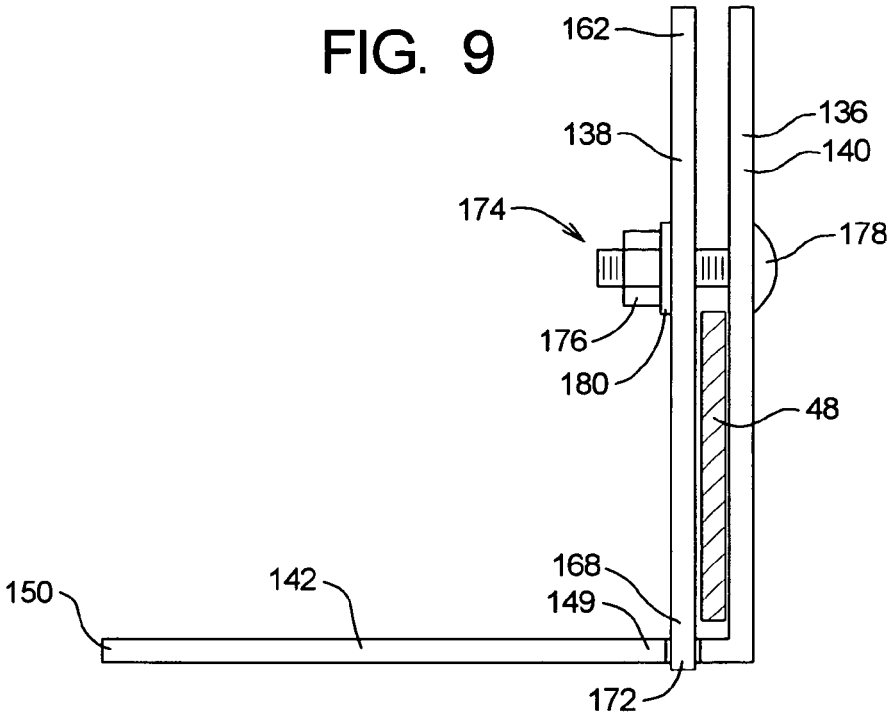
FIG. 9 is a side elevational view of FIG. 7.
Figure 10:
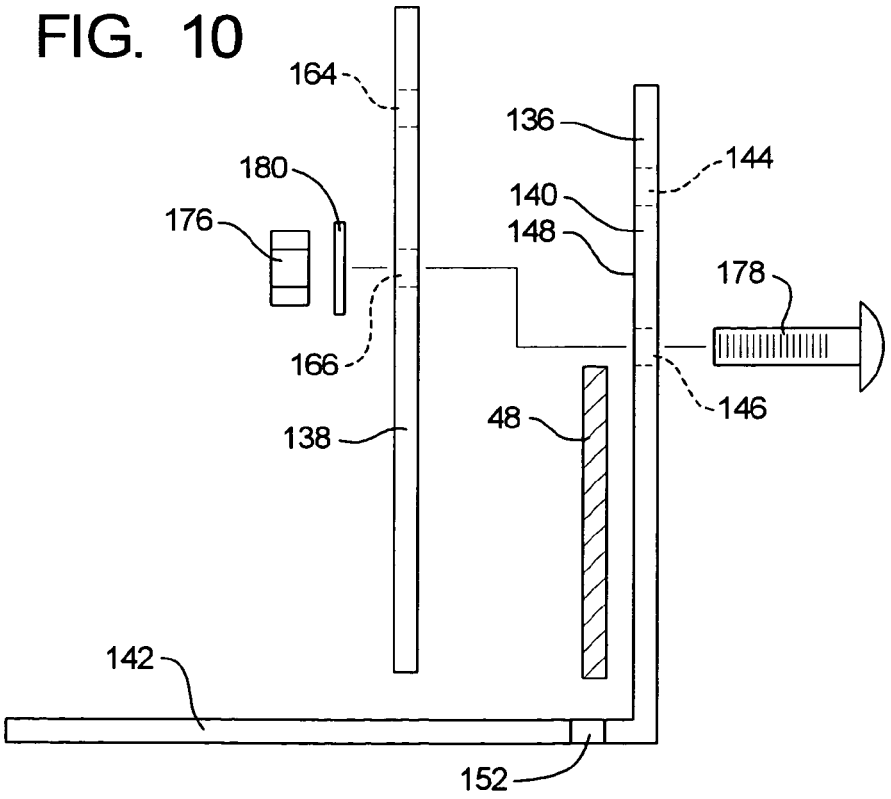
FIG. 10 is a side elevational exploded view of FIG. 7.

In the particular configuration shown in FIG. 8, the bolt 178 is inserted through the two openings 146 and 166. However, in some instances the vertical dimension of the cage element 48 is greater, and in those instances the bolt 178 is inserted into the upper openings 164 and 144. Thus, the cage connecting component 70 is clamped rigidly to the cage element 48.

As indicated earlier in this text, there is a cage engaging restraint section 73 which comprises the elongate bar 89 having a lengthwise slot 90. Also as described previously, there is the fastener 88 which connects at the forward connecting location 92 with the fastener 88 extending through the slot 90 and also through the bolt of the slot 87 to connect the cage engaging restraint section 73 to the upper connecting portion 85 of the rail connecting component 68. At the second connecting location 94 (see FIG. 2) there is a second connecting assembly 95 which comprises a bolt that extends through the slot 90, and it also extends through the slot 160 which is at the forward end of the horizontal portion 142. This slot 160 is also indicated in the FIG. 2.

As can be seen from examining FIG. 2, when the cage engaging restraint section 73 is in it's operating position, it is connected at the connecting location 92 by means of the fastener assembly 88, with the bolt of the fastener extending through the slot 90 the member 89. The cage engaging restraint section 73 is connected at it's second connecting location 94 to the horizontal portion 142 of the positioning component 136 by the bolt of the connecting assembly 95 extending through the slot 90 of the cage engaging restraint section 73 and the slot 160 of the horizontal portion 142 of the positioning component 136. Also by loosening two fastener assemblies 88 and 95 the angular position of the cage engaging restraint section 73 can be changed, and also by moving the fasteners 88 and 90 along their related slots, the distance between the two connecting locations 92 and 94 can be changed.

e) Installation of the First Embodiment of the Present Invention

The first step in installation of one of the fall restraint sections 60 is to first locate the position on the rail 53 where it is to be connected and position the rail engaging portion 74 of the rail engaging restraint section 72 so that it's lower rail connecting portion 76 is in engagement with the upper rail 53 so that the vertical and horizontal positioning portions 106 and 108 are positioned against the flanges 96 and 98 of the rail 53. Then the clamping compound 124 is pressed against the rail 53 and the two connecting assemblies 130 are used to make the connections as shown in FIG. 4.

The next step is to position the extension portion 75 against the upwardly extending restraint portion 78 of the rail engaging portion 74. The extension portion 75 is positioned so that it's upper end is at approximately the same level as that of the lowermost cage element 48, and then the bolts of the two fasteners 84 are inserted through two selected openings 82 of the vertical extension element 80 of the extension portion 75 and also through the slot 79 of the upwardly extending portion 78. Then the nuts are threaded on to the bolts and tightened.

The next step is to connect the cage connecting component 70 to the lowermost cage element 48. This is accomplished by placing the positioning component 136 against the inside surface of the lowermost cage element 48 as shown in FIG. 8, and then placing the clamping component 138 against the outside surface of the cage element 48 and lowering it so that the two legs 172 fit into the notches 152 of the positioning member 142. Then the bolt 178 of the fastener 174 is inserted through one or the other of the pairs of holes 146–166 or 144–164, and the nut 176 with the washer 180 is threaded on to the bolt 178 to press the clamping member 138 tightly against the cage element 48. After this, the cage connecting component 70 is positioned as shown in FIG. 2 being just above the connecting portion 85 and the horizontal portion 142 of the positioning component 136. The fastener assemblies 88 and 95 then are utilized to rigidly attach the cage engaging restraint section to both the cage connecting component 70 and also to the upper connecting portion of the elongate rail component 62.

Then the other restraint sections 60 are installed in the same manner. The locations of these restraint sections 60 are selected to be at sufficiently close intervals to properly perform their safety function.

f) The Rail Connecting Component of the Second Embodiment of the Second Invention The second embodiment of the present invention is in large part the same as the first embodiment, except that the rail connecting component 68 of the first invention differs in this second embodiment so that a connect to the rail connecting component can be connected to a rail member having a cylindrical cross section. However, the rail member could have other cross sectional configurations such as square, rectangular, oblong, etc.

To describe this second embodiment, reference is made to FIGS. 11 through 14. Some of the members of the rail connecting component 68 of the first embodiment are utilized in this second embodiment, and in describing this second embodiment, those corresponding components will be given the same numerical designations as in the first embodiment, but with an "a" suffix distinguishing those of the second embodiment.

Figure 11:
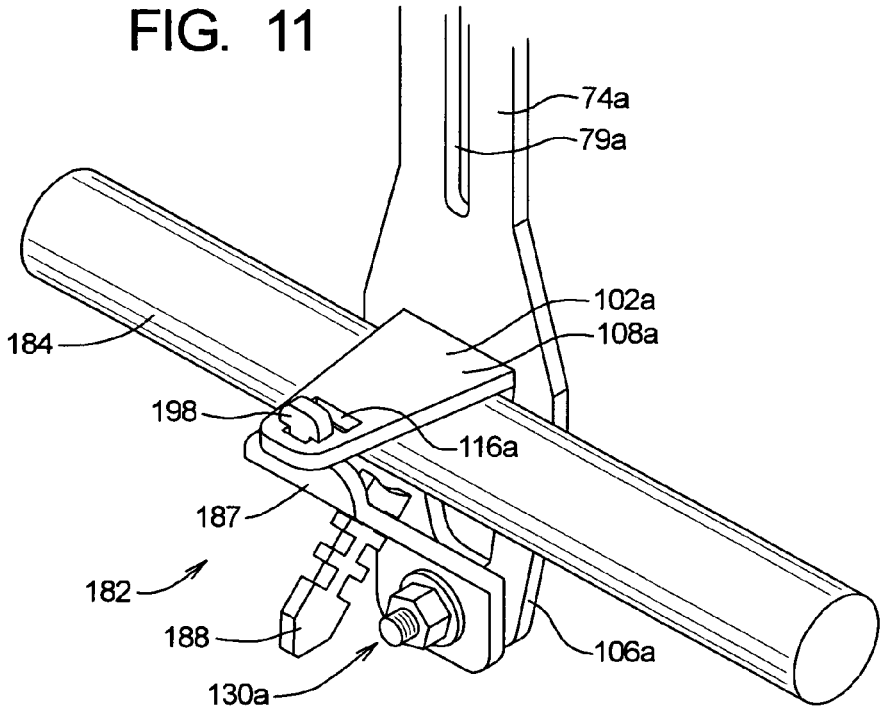
FIG. 11 is an isometric view of a rail clamping component of a second embodiment.
Figure 12:
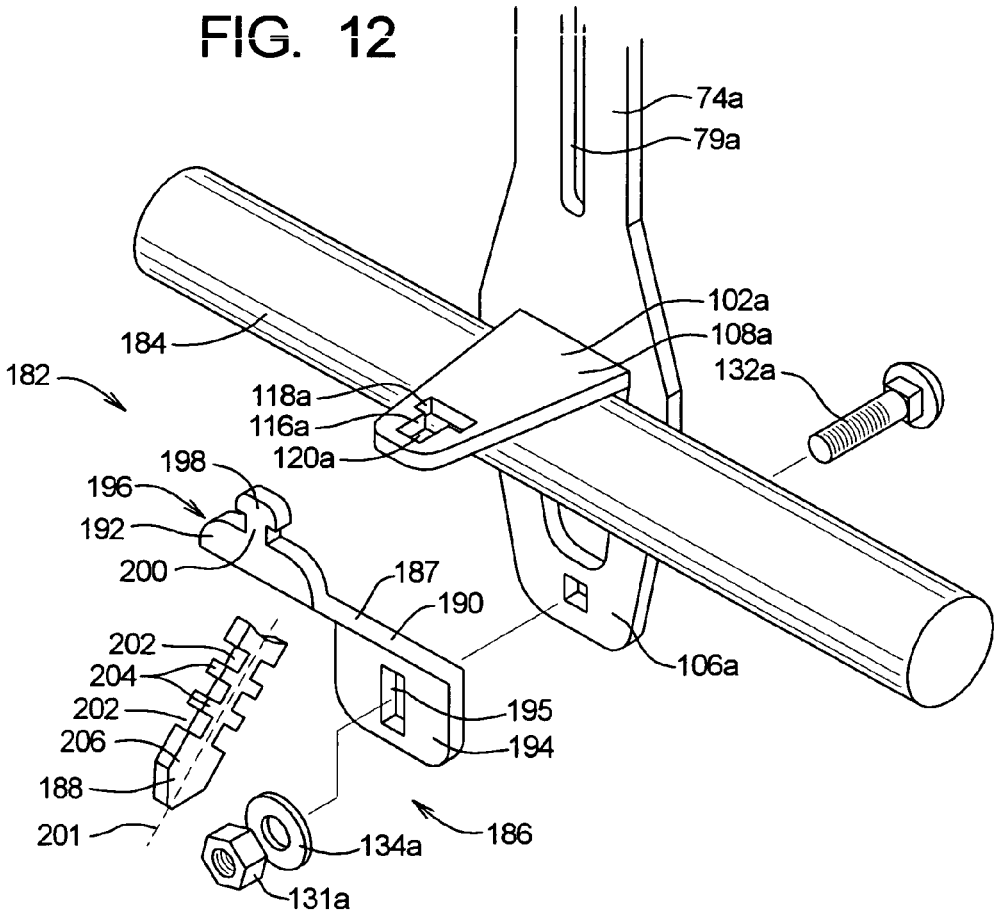
FIG. 12 is an isometric exploded view of FIG. 12.
Figure 13:
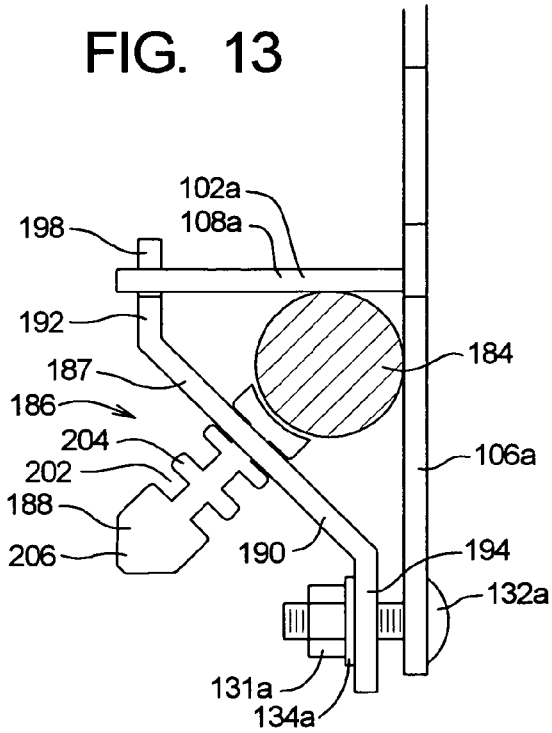
FIG. 13 is a side elevational view of FIG. 11.
Figure 14:
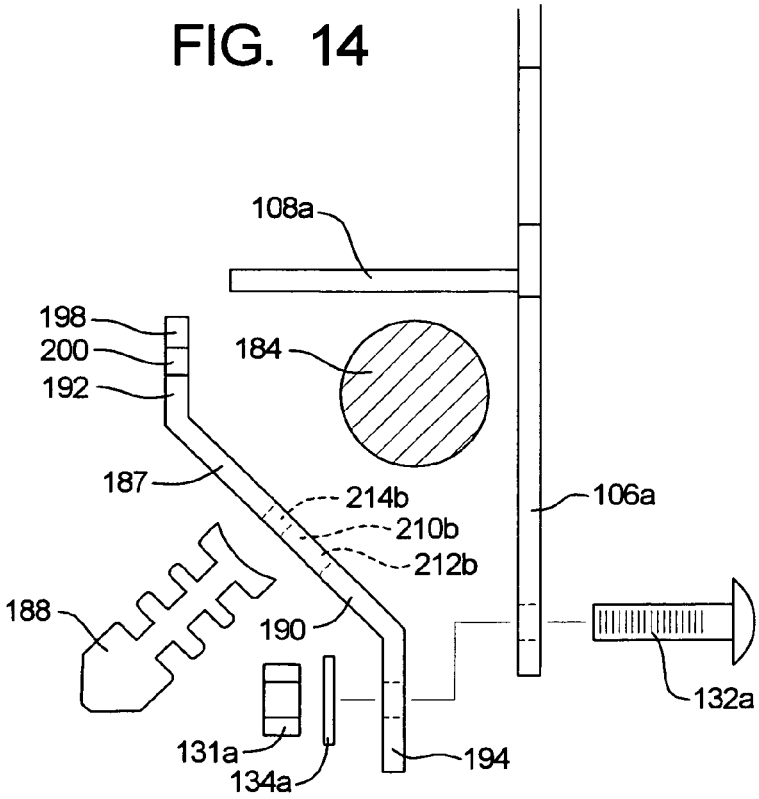
FIG. 14 is a side elevational exploded view of FIG. 11.

This second embodiment is shown in FIGS. 11 through 14. Reference will initially be made to FIGS. 11 and 12 which are isometric views, with FIG. 11 showing the second embodiment in it's operating position, and with FIG. 12 being an exploded view.

This second embodiment is given the general designation 182, and it is designed to engage the round upper rail which is indicated at 184. The positioning component 102*a* is shown as being the same as the positioning component 102 of the first embodiment. Thus, there is the vertical portion 106*a* and the horizontal portion 108*a*. Also, there is a lower connecting assembly 130*a*.

The difference in the second embodiment is that the clamping component 104 the first embodiment is not used. Rather, there is a clamping assembly 186 that comprises a clamping connecting member 187 and a clamping rail engaging member 188.

The clamping connecting member 187 comprises a central connecting portion 190 an upper connection portion 192 and a lower connection portion 194. The upper and lower connecting portions 192 and 194 are substantially parallel to one another, and both of these make an angle with the central connecting portion 190 of approximately 135 degrees. Thus, in the operating position of FIG. 11, it can be seen that the lower connecting portion 194 is pressing against the vertically aligned portion 106*a* of the positioning component 102*a*. The lower connecting portion 194 has a slot opening 195 to receive the bolt 132*a*.

With reference to FIG. 12, the upper connecting portion 192 has a T shaped connecting portion 196 having a upper cross member 198 of a greater width, and a smaller width connecting portion 200. It will be recalled that in the description of the first embodiment, in FIG. 5 there is shown the T-shaped opening 116. There is the same T shaped opening 116*a* in the second embodiment, and there is a wider opening portion 118*a* at what would be the upper cross member of the T, and a narrow opening portion 120*a* which would be at the leg portion of the T.

It can be seen that the connection is made by moving the cross member portion 198 upwardly through the wider opening portion 118*a* until it is above the level of the upper surface of the horizontal portion 108*a*, and then moving the clamping connecting member 187 forwardly (i.e. away from the vertical portion 106*a*) so that the broader connecting cross member 198 is over the narrower opening portion 120*a*, with the narrower smaller width portion 200 being positioned within the narrower opening portion 116*a*.

The aforementioned rail engaging member 188*a* can be seen more clearly in FIG. 12. This has an overall configuration of rectangular flat bar having a lengthwise axis 201, and at space intervals along the lengthwise axis 201 there are pairs of oppositely formed notches 202 on opposite sides of the lengthwise axis 201, thus forming a plurality of oppositely extending pairs of fingers 204. At the outer end of the clamping connecting member 187 there is an end portion 206 which can be manually grasped to manipulate this clamping connecting member 187 into the proper position.

Figure 15:
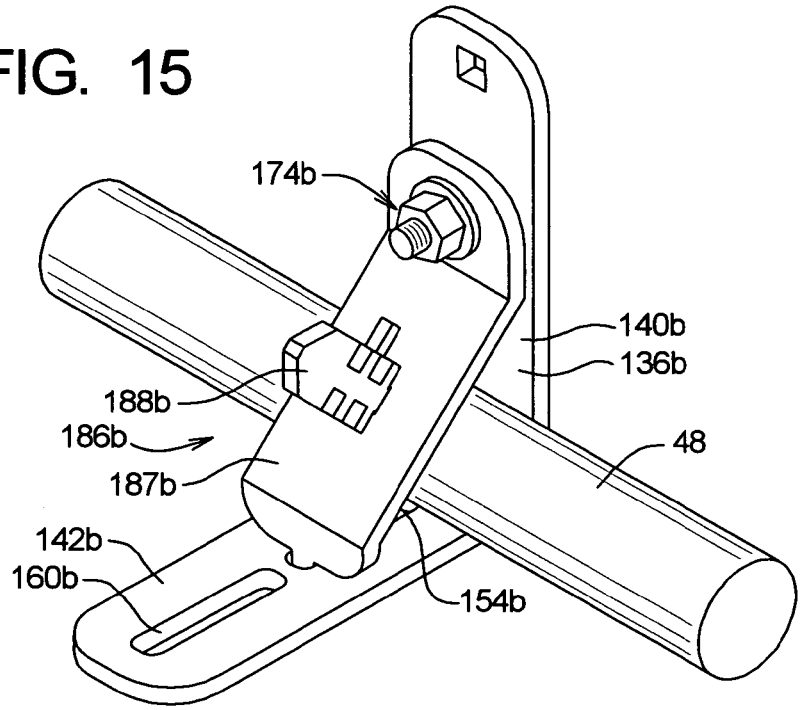
FIG. 15 is an isometric view of a cage element connecting component of a third embodiment.
Figure 16:
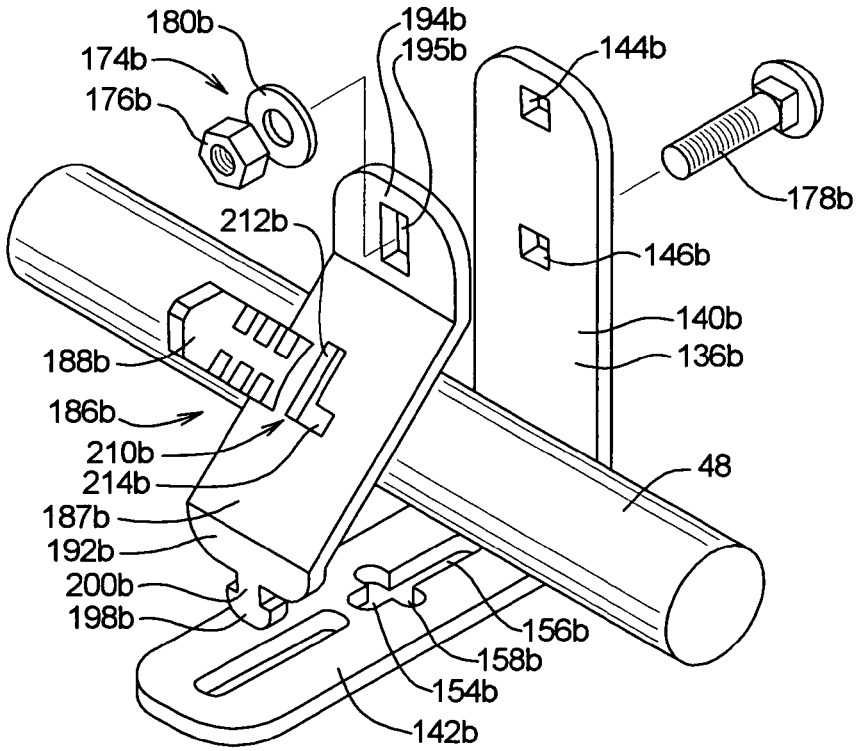
FIG. 16 is an isometric exploded view of FIG. 15.
Figure 17:
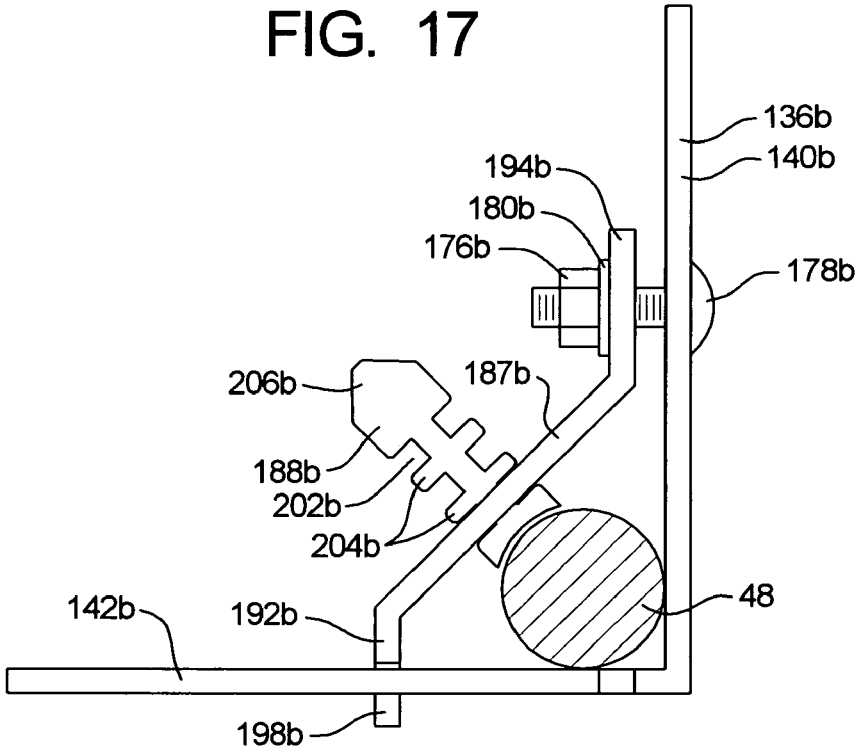
FIG. 17 is a side elevational view, partly in section, of FIG. 15.
Figure 18:
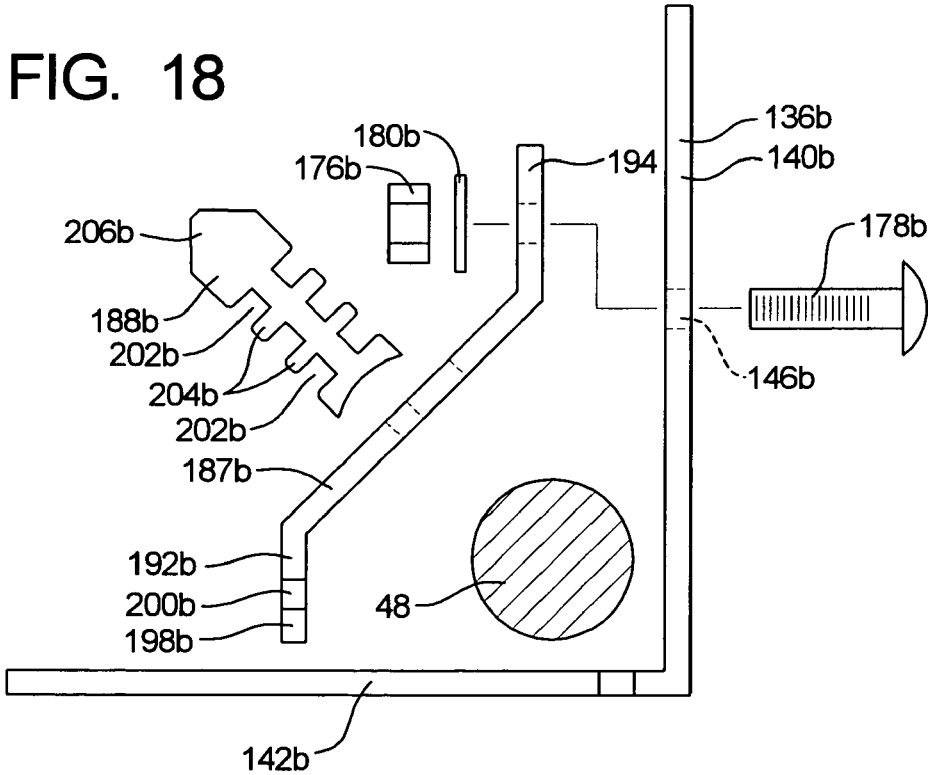
FIG. 18 is a side elevational exploded view similar to FIG. 17.
Figure 19:
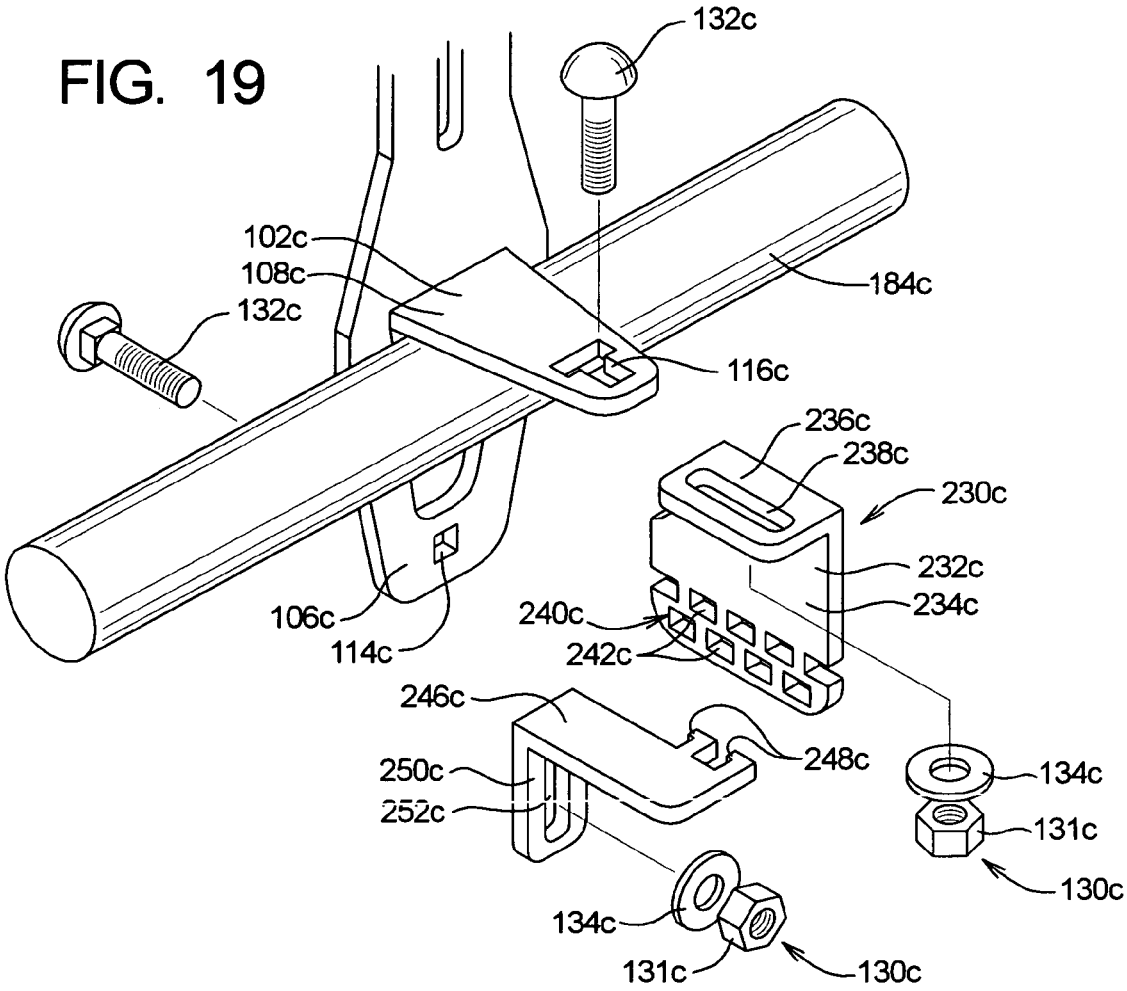
FIG. 19 is a isometric view showing a fourth embodiment of the present invention, with the fasteners being shown as an exploded view.

The clamping assembly 186 is also used in a third embodiment which is shown in FIGS. 15–18, and the connecting member 187 can be seen more clearly in the FIG. 16 with regard to the central connecting portion 190. Accordingly, reference will be made to FIG. 16 for the following several sentences to describe this central connecting portion 190 this connecting portion 190 has an L shaped opening 210*b* which comprises a lengthwise slot 212*b* and a lateral slot portion 214*b*. The rail engaging member 188 can be inserted so that one of the pairs of notches 192 is within slot portion 212*b* of the L shaped opening after which the rail engaging member 188 can be moved a short distance laterally so that two adjacent pairs of the fingers 194 fit on opposite surfaces of the central connecting portion 190. Thus, by selecting the particular pair of notches 192, the rail engaging member 187 can be positioned at various engaging positions, depending on the diameter of the cylindrical rail member 184. Then when the fastener 130*a* is tightened to rail engaging member is pressed against the rail member 88 to make a rigid connection.

g) The Cage Connecting Component of a Third Embodiment

The third embodiment of the present invention is in large part the same as the first and second embodiment except that the cage connecting component differs in this third embodiment so that the cage connecting component can be connected to a cage element having a cylindrical cross section.

To describe this third embodiment, reference is made to FIGS. 15 through 18. As it turns out, all of the members of the cage connecting component of the third embodiment are the same as corresponding components of the first and second embodiment. Accordingly, so these can be better identified, those components that first appear in the first embodiment will be given the same numerical designations as used in the first embodiment, and those which are derived from the second embodiment will be given the same numerical designations as those appearing in the second embodiment. However, a "b" suffix will be added to distinguish that these are in the third embodiment.

With reference first to FIGS. 15 and 16, there is shown a cylindrical cage element 48. There is a positioning component 136*b* which in turn comprises the vertical portion 140*b* and the horizontal portion 142*b*. Further, there are the two upper openings 144*b* and 146*b*. The lower member 142*b* has the double slotted opening 154*b* that has the lengthwise aligned longitudinal slot 156*b* and the cross slot portion 158*b*. There is the fastener assembly 174*b* comprising the nut 176*b*, the washer 180*b* and the bolt 178*b*, and this connects the connecting portion 1946 of the clamping connecting member 1876 to the vertical portion 106*b* by means of the slot like opening 195*b*.

The clamping component is essentially the same as that shown in the second embodiment. According, the clamping component is in the form of a clamping assembly 186*b* which comprises the clamping connecting member 187*b* and the rail engaging member 188*b*.

In this third embodiment, the positioning section 136*b* functions as in the first embodiment so as to engage at least two surface portions of the cage element 48, and the clamping assembly 186*b* functions in essentially the same way as the clamping assembly 186 of the second embodiment. Thus, the clamping connecting member 187*b* has it's cross member 198 inserted through the slot like cross member portion 158*b* to secure that end of the clamping connecting member 187*b* and there is the opening at 195*b* to connect with the bolt 178*b*. It is believed that the functions of the components of this third embodiment are readily understandable are from the early disclosure of the corresponding components of the same.

h) The Rail Clamping Component of a Fourth Embodiment of the Present Invention

In describing this fourth embodiment, components which are similar to the components of earlier embodiments will be given like numerical designations, with a "c" suffix distinguishing those of this fourth embodiment.

In this fourth embodiment, there is shown a round rail section 84, a positioning component 102*c* and a clamping component 230*c*. The positioning component 102*c* is substantially the same as that shown in FIG. 4 and in some of the other embodiments. Thus, there is the vertical positioning portion 106*c* and the horizontally aligned positioning portion 108*c*. Also, there is a lower opening 114*c* and the upper opening 116*c*. Also, there are two fastening assemblies 130*c*, each comprising the nut 131*c*, the bolt 132*c* and the washer 134*c*.

The clamping component 230*c* comprises a clamping member 232*c* having a vertically aligned plate like portion 234*c* and a laterally extending plate like member 236*c*. There is elongate slot 238*c* in the laterally aligned member 236*c*. At the lower part of the vertical member 234*c* there is a position adjustment portion 240*c* comprising a plurality of aligned square openings 242*c*. There is provided a connecting member 246*c* that has a pair of outwardly extending hook like fingers 248*c*. These fingers 248*c* arrange to fit in an adjacent pair of the square openings 242*c*. At the forward end of the connecting member 246*c* there is a downwardly extending flat member 250*c* having an elongate slot 252*c*.

Figure 20:
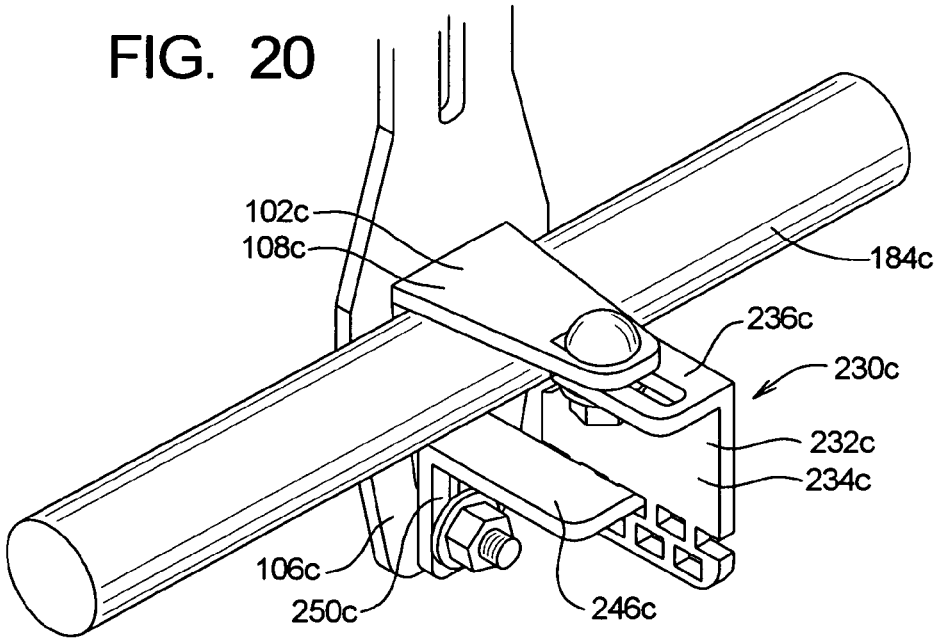
FIG. 20 is an isometric view of FIG. 19, also showing the clamping member of an exploded view.

In the operating position, the connecting member 246*c* is attached to the clamping member 232*c* as shown in FIG. 20, and then is moved to be adjacent to the positioning component 104*c*. The slot 238*c* is aligned with the opening 116*c* and the fastener assembly 130*c* is then utilized to secure the clamping member 232*c* to the horizontal positioning portion 108*c*. Also, the slot 252*c* is aligned with the opening 114*c*, and the clamping assembly is utilized to make the connection at that location.

It is believed that the operation of this fourth embodiment is readily apparent from the prior description of the various embodiments.

It is to be understood that various modifications could be made to the present invention without departing from the teachings thereof. For example, while one type of fastener is shown being used, other types of fasteners could also be employed. Further, there are shown extendable and retractable elements and it is known in the art that there are other methods of making members extendable and retractable, and these could have different cross sectional configurations. Also, for example, the cage engaging restraint section has been shown as a single member by having varying connection locations, so that it effectively functions as an extendable and retractable member and this could have other configurations.

The above instances are given by way of example, and it will be obvious of one of ordinary skill in this art to substitute other functional equivalents and be within the scope of the present invention.

What is claimed is:

1. A fall restraint system to be used for a ladder system, where the ladder system comprises a platform, a ladder extending upwardly from said platform, a safety cage extending around said ladder and having a cage element located at a first elevation above said platform, a guard rail extending at least partly around said platform and having a rail element positioned at an elevation above said platform and below said cage element so that there is an open region located between said rail element and said cage element, said fall restraint system comprising:

a) a plurality of restraint sections located at spaced locations at said open region, each restraint section comprising:

i) an elongate restraint component having first and second end portions and arranged to be positioned between said cage element and said rail element;

ii) a rail connecting component arranged to mechanically attach the first end portion of the restraint component to the rail element;

iii) a cage connecting component arranged to mechanically attach the second end of the portion of the restraint component to the cage element;

b) said restraint component being arranged to be able to be extended or retracted to enable it to be joined to the cage element and rail element so that when the rail element and the cage element are at different positions relative to one another, the restraint section can be extended or retracted as needed to made a proper connection to said rail element and said cage element.

2. The restraint system as recited in claim 1 wherein each restraint section comprises:

a) a generally vertical first restraint section having a substantial vertical alignment component and being adapted to be connected to said rail element so as to extend upwardly therefrom;

b) a generally horizontal second restraint section having a substantial horizontal alignment component and adapted to be connected between an upper portion of said first restraint portion section and to extend to said cage element and be connected thereto.

3. The restraint system as recited in claim 2, wherein said first restraint section is arranged to be extendable and retractable along a first lengthwise axis having a substantial vertical alignment component.

4. The restraint system as recited in claim 3, wherein second restraint section is arranged to be positioned at different angular positions extending between the first restraint section and the cage element.

5. The restraint system as recited in claim 2, wherein said generally vertical first restraint section comprises a rail engaging portion and a vertically adjustable upper connecting portion adapted to be connected to said second restraint section at different elevations.

6. The restraint system as recited in claim 5, wherein said vertically adjustable upper connecting portion comprises an elongate extension portion; and said rail engaging restraint section has an upwardly extending restraint portion, said elongate extension portion and said upwardly extending restraint portion being arranged to be adjacent and in alignment with one another so as to be extendable and retractable relative to one another.

7. The restraint system as recited in claim 6, wherein said rail connecting component is adapted to be rigidly connected to said rail element and also rigidly connected to said upwardly extending restraint portion, so that said upwardly extending restraint portion is able to be fixed in an upwardly extending restraint position.

8. The restraint system as recited in system 5, wherein said vertically adjustable upper connecting portion is arranged to be fixedly connected to the rail engaging portion so that a location of the vertically adjustable upper connecting portion can be fixed, said second restraint section having a first connection portion that connects to the vertically adjustable upper connecting portion in a manner that its angular location in a horizontal plane can be changed.

9. The system as recited in claim 8, wherein said second restraint section has a second connection portion connecting to said cage connecting component that permits change of angular position of said second restraint section relative to said cage connecting component.

10. The system as recited in claim 9, wherein said second restraint section has first and second connecting locations, which are arranged so that a distance between said first and second connecting locations of the second restraint section can be changed.

11. The restraint system as recited in claim 1, wherein at least one of said rail engaging component and said cage engaging component comprises a positioning component having two spaced surface portions that are arranged to engage spaced contact locations of one said rail element or said cage element, and a clamping component to engage said one of the rail element or the cage element in the clamping position, a fastener to engage said positioning component and said clamping component to press said clamping component into clamping engagement in the clamping position.

12. The restraint system as recited in claim 11, wherein said one of said rail engaging component and said cage engaging component comprises an elongate element having a right angle configuration where there are two flanges at right angles to one another, said positioning component having first and second positioning portions having a right angle configuration and are arranged to engage the surfaces of the right angle element that have an outside angle of about 270 degrees with respect to one another.

13. The restraint system as recited in claim 12, wherein said clamping component has two clamping portions connected to one another at a right angle, and having a configuration to engage surfaces of said right angle element that make an angle between each other of about 90 degrees.

14. The restraint system as recited in claim 11, wherein said positioning component and said clamping component are arranged to engage an elongate element having three outer surface contact locations, said positioning component comprising two positioning portions which join each other at an angle other then a straight angle, and having adjacent surfaces of less the 180 degree angle and which have two contact locations, said clamping component having a contact surface portion that is positioned to engage said third contact location of the elongate element and press the elongate element into a clamping engagement so as to be clamped between the two contact surface portions of the positioning component and the contact surface portion of the clamping member.

15. The restraint system as recited in claim 14, wherein said clamping component has a first connecting location which is mechanically connected to said positioning element, and a second connecting location where a fastener engages said clamping element and said positioning element, said fastener being arranged to exert a force on said clamping element to move the clamping element into clamping engagement.

16. The restraint system as recited in claim 15, wherein said clamping component further comprises an adjustable clamping contact member being capable of connecting to said clamping component at different clamping locations so as to accommodate elongate elements of different sizes.

17. A combination of a ladder system and a fall restraint system, said combination comprising:

a) said ladder system comprising: a platform, a ladder extending upwardly from said platform, a safety cage extending around said ladder and having a cage element located at a first elevation above said platform, a guard rail extending at least partly around said platform and having a rail element positioned at an elevation above said platform and below said cage element so that there is an open region located between said rail element and said cage element;

b) said fall restraint system comprising: a plurality of restraint sections which are connected to be able to be extended or retracted to a selected operating position, and which are located at spaced locations at said open region and are at selected operating positions relative to the rail element and the cage element, each restraint section comprising:

i) an elongate restraint component having first and second end portions which are positioned between said cage element and said rail element;

ii) a rail connecting component mechanically attached to the first end portion of the restraint component to the rail element;

iii) a cage connecting component mechanically attached to the second end of the portion of the restraint component to the cage element.

18. The combination as recited in claim 17 wherein each restraint section comprises:

a) a generally vertical first restraint section having a substantial vertical alignment component and being adapted to be connected to said rail element so as to extend upwardly therefrom;

b) a generally horizontal second restraint section having a substantial horizontal alignment component and adapted to be connected between an upper portion of said first restraint portion and to extend to said cage element and be connected thereto.

19. The combination as recited in claim 18, wherein said first restraint section is arranged to be extendable and retractable along a first lengthwise axis having a substantial vertical alignment component.

20. The combination as recited in claim 19, wherein said cage engaging restraint section is arranged to be positioned at different angular positions extending between the rail engaging restraint section and the cage element.

* * * * *